US006189221B1

(12) United States Patent
Barrow et al.

(10) Patent No.: US 6,189,221 B1
(45) Date of Patent: Feb. 20, 2001

(54) CAN OPENER APPLIANCE HAVING A SIDE-CUTTING MECHANISM

(75) Inventors: Mary K. Barrow; Eric S. Wall, both of Clinton, MO (US)

(73) Assignee: The Rival Company, Kansas City, MO (US)

( * ) Notice: Under 35 U.S.C. 154(b), the term of this patent shall be extended for 0 days.

(21) Appl. No.: 09/224,345

(22) Filed: Dec. 31, 1998

(51) Int. Cl.[7] ..... B67B 7/70

(52) U.S. Cl. ..... 30/417; 30/421; 30/424

(58) Field of Search ..... 30/416, 417, 420, 30/421, 422, 423, 424

(56) References Cited

U.S. PATENT DOCUMENTS

| | | | |
|---|---|---|---|
| D. 202,268 | 9/1965 | Reed . | |
| D. 219,200 | 11/1970 | McCue . | |
| D. 229,603 | 12/1973 | Eckle . | |
| D. 230,005 | 1/1974 | Weiss . | |
| D. 240,700 | 7/1976 | Scott . | |
| D. 276,406 | 11/1984 | Johnson et al. . | |
| D. 291,173 | 8/1987 | Stowell et al. | D8/36 |
| D. 306,548 | 3/1990 | Mezey | D8/36 |
| D. 366,404 | 1/1996 | Indindoli | D8/36 |
| D. 366,997 | 2/1996 | Carbone | D8/36 |
| 2,204,368 | 6/1940 | Kublin | 30/416 |
| 2,579,189 | 12/1951 | Jensen . | |
| 2,651,838 | 9/1953 | Curtis . | |
| 2,662,279 | 12/1953 | Wilson . | |
| 2,679,098 | 5/1954 | Deicken . | |
| 2,738,943 | 5/1956 | Lawrence . | |
| 2,765,207 | 10/1956 | Moore . | |
| 2,771,263 | 11/1956 | Boho . | |
| 2,896,319 | 7/1959 | Pinette . | |
| 2,925,237 | 2/1960 | Fox . | |
| 2,979,815 | 4/1961 | Rhode et al. . | |

(List continued on next page.)

FOREIGN PATENT DOCUMENTS

| | | | |
|---|---|---|---|
| 30 48 063 | 7/1982 | (DE) . | |
| 1396874 | 3/1965 | (FR) . | |
| 154429 | 12/1920 | (GB) . | |
| 1252374 * | 2/1968 | (GB) | 30/417 |

OTHER PUBLICATIONS

Cornwell Corporation, "The Three Minute Egg," Jun. 21, 1973, Home Furnishings Daily, p. 13.

Cornwell Corporation, "The Three Minute Egg," Jan. 8, 1974, Home Furnishings Daily, p. 19.

Wellman Industrial Co., Ltd., "Combination Knife & Scissors Deluxe Can Opener," Dec. 1980, Hong Kong Enterprise, p. 35.

Fatia Industrial Co., Ltd., "The Best Products of . . . " Nov. 1988, Hong Kong Enterprise, p. 230.

* cited by examiner

*Primary Examiner*—Hwei-Siu Payer
(74) *Attorney, Agent, or Firm*—Brinks Hofer Gilson & Lione

(57) ABSTRACT

This invention is directed to a can opener appliance with a side cutting mechanism. The can opener appliance includes housing portions, which include a cutter support mounted therein. A cutter wheel is mounted at least partially within the cutter support and has a cutting edge for severing a can wall. A traction wheel is also positioned inside the housing portions of the can opener appliance. The traction wheel has a gripping surface to engage the can. The cutter wheel and the traction wheel are rotatable and the axes of rotation of the wheels are substantially perpendicular to each other. The wheels are positioned adjacent and spaced apart from each other to define a gap to accept a can to be opened. One of the wheels is moveable towards the other to engage and lock the can between the wheels. The cutter wheel then acts to sever the can wall and the traction wheel acts to move the can past the cutter wheel The cutter wheel is formed of a drawn tool steel with a Rockwell C hardness from about 53 to about 57.

6 Claims, 5 Drawing Sheets

U.S. PATENT DOCUMENTS 2,997,785 8/1961 Pinette .
3,079,683 3/1963 Carew et al. .
3,105,297 10/1963 Clowers .
3,156,044 11/1964 Congdon et al. .
3,176,063 3/1965 Jepson et al. .
3,216,108 11/1965 Jepson et al. .
3,254,406 6/1966 Hubrich .
3,307,255 3/1967 Hubrich .
3,313,023 4/1967 Jepson et al. .
3,348,305 10/1967 Bielak et al. .
3,360,853 1/1968 Chambers et al. .
3,376,671 4/1968 Wolter .
3,433,444 3/1969 Smith .
3,477,263 11/1969 Jepson et al. .
3,520,056 7/1970 Scott .
3,585,717 6/1971 Bielak et al. .
3,673,682 7/1972 Yamamoto .
3,675,321 7/1972 Arel et al. .
3,689,997 9/1972 McLean .
3,698,084 * 10/1972 Peterson ..... 30/417
3,706,135 12/1972 Fukunaga et al. .
3,763,748 10/1973 Gallagher, Jr. .
3,765,085 10/1973 Ponczek et al. .
3,781,989 * 1/1974 Swetlitz et al. ..... 30/417
3,805,380 4/1974 Yamamoto .
3,818,589 6/1974 Oberto .
3,845,928 11/1974 Barrett et al. .
3,858,313 1/1975 Yamaguchi .
3,881,247 5/1975 Niwa .
3,911,571 10/1975 Ponczek et al. .
3,942,247 3/1976 Ponczek et al. .
3,949,468 4/1976 McLean et al. .
3,955,276 5/1976 Pauty .
3,982,455 9/1976 Bowman .
4,028,805 6/1977 Figlia .
4,046,038 9/1977 West .
4,053,981 10/1977 Aberer .
4,086,835 5/1978 Frederick .
4,196,821 4/1980 Teti, Jr. et al. .
4,207,676 6/1980 Okumura .
4,251,917 * 2/1981 Peres ..... 30/417
4,301,595 11/1981 Franek .
4,389,780 6/1983 Ostroski et al. .
4,466,664 8/1984 Kondou .
4,534,108 8/1985 Yamamoto et al. .
4,561,182 12/1985 Yamamoto et al. .
4,563,818 1/1986 Kreth et al. .
4,620,476 11/1986 Brym .
4,635,615 1/1987 Itoh et al. .
4,663,849 5/1987 Nickelson .
4,702,007 10/1987 Nomura et al. .
4,733,472 3/1988 Belcourt .
4,734,986 4/1988 Peters .
4,754,550 7/1988 Koo .
4,782,594 11/1988 Porucznik et al. .
4,831,735 5/1989 Bast et al. .
4,833,783 5/1989 Davel .
4,860,455 8/1989 Conneally .
4,922,617 5/1990 Kurz .
4,949,928 8/1990 Hoshino .
4,979,308 12/1990 Moore .
4,995,164 2/1991 Borger et al. .
5,022,159 6/1991 Cressman et al. .
5,121,546 6/1992 Chong .
5,170,565 12/1992 Brisard .
5,181,322 1/1993 Koo .
5,211,368 5/1993 Kitamura .
5,219,240 6/1993 Kitamura .
5,289,638 3/1994 Chase .
5,291,658 3/1994 Wilson et al. .
5,313,708 5/1994 Edwards et al. .
5,347,720 9/1994 Pereira .
5,367,776 11/1994 Chong ..... 30/417
5,383,637 1/1995 Biber .
5,421,092 6/1995 Guilmette et al. .
5,478,998 12/1995 Charych et al. .
5,492,296 2/1996 Biber .
5,503,491 4/1996 Lu .
5,581,897 12/1996 Liebscher .
5,651,183 7/1997 Cincotta et al. .
5,682,681 11/1997 Cincotta et al. .
5,692,309 12/1997 Pereira .-

103
14
68
61
61a
78
18
60
63
13
11
61b
103
38
10
38
12.5°

32
2
5
10
11
20
63
64
125
13
14

CAN OPENER APPLIANCE HAVING A SIDE-CUTTING MECHANISM

FIELD OF THE INVENTION

This invention relates to a can opener appliance, and more particularly to a can opener appliance having a side-cutting mechanism.

BACKGROUND OF THE INVENTION

Appliances that open cans are well known in the art. Generally, these can opener appliances include a traction wheel and a cutter wheel. The traction wheel biases the top surface of a can against the cutter wheel, which cuts through the top lid of the can. The traction wheel also acts to drive the can opener appliance around the top of the can, thereby cutting through the can all around the circumference of the can.

One type of can opener appliance cuts through and removes the top lid of the can by piercing and cutting through the lid to gain access to the contents of the can. The main problem with this type of can opener is that the cut edges, both of the cut lid that is removed after the cutting operation and of the body of the can itself, are sharp and thus may be dangerous to the consumer. Another problem is that an unsanitary cutter may come into contact with the contents of the can, and if the cutter is not particularly sharp, the cutter wheel may form small shavings that can contaminate the contents of the can. Additionally, if the entire circumference of the top lid of the can is cut, then the cut lid may fall into the can, thereby also contaminating the contents of the can. Furthermore, it may be difficult and/or messy for the operator to remove the cut lid from the contents of the can.

To address these problems, can opener appliances have been developed that are designed to separate the outside seam of the can and leave non-sharp edges. Examples of these can opener appliances include U.S. Pat. No. 3,719,991, issued to French; U.S. Patent No. Reissued 27,504, issued to Smith; U.S. Pat. No. 1,935,680, issued to Von Wolforsdorf; U.S. Pat. No. 4,782,594, issued to Porucznik et al.; and U.S. Pat. No. 3,510,941, issued to Fyfe. In this manner, the appliance cuts the can at the seam where the top of the can is folded and welded to the cylindrical body of the can during the manufacture of a can (after the contents have been placed into the can). Because the can is cut at the seam, the cut edges, both of the body of the can itself and of the top of the can, are smooth and do not present a hazard for the consumer.

The patents cited above use a pin sliding in an arcuate slot for engaging and locking the can opener appliance on the can to be opened. While these locking arrangements work adequately, over time there is a tendency for the moving parts to wear. The result of this wear is that the engaging and locking function of the appliance is impaired, leading to difficulty in cutting through the can and keeping the appliance in position on the can.

Improvements on the above can opener appliances include U.S. Pat. Nos. 5,121,546 and 5,367,776, both issued to Chong. In the Chong patents, the can opener appliance includes thrust surfaces and a separating means that can be introduced between the separating means. The separating means, typically a ball bearing and stacked ring, is introduced between the thrust surfaces, typically springs, to move a moveable thrust surface away from a fixed thrust surface to separate the traction wheel and the cutter wheel. By this means, the can opener appliance is brought to the cutting position, and the cutter wheel is utilized to cut through the can.

There have been difficulties in producing a can opener appliance that has a side cutting mechanism that is also assisted by an electric motor. All of the patents cited above, except the Porucznik et al. patent, are directed to side-seam cutting can opener appliances which are driven by manually turning a key connected to a traction wheel. It has now been found the side cutting mechanism as disclosed in the Chong patents can be modified to work effectively with an electric motor to provide an electric can opener appliance.

SUMMARY OF THE INVENTION

One aspect of the present invention provides an appliance for removing the rim of a can, which includes a cutter support having a first vertical wall, a cutter wheel, a traction wheel, an activation lever, and a drive motor. The cutter wheel is rotatable about an axis, and is mounted at least partially within the cutter support so that the axis of rotation is substantially parallel to the vertical wall and an edge of the wheel is exposed from the cutter support. The cutter wheel comprises 01 draw tool steel having a hardness range of between approximately 53 and 57 on the Rockwell "C" scale. The traction wheel is mounted to a distal end of a shaft. The annular portion of the traction wheel preferably comprises a gripping surface. The shaft is mounted to the cutter support and is substantially perpendicular to the axis of the cutter wheel. The shaft and the traction wheel are reciprocally moveable axially relative to the cutter support and the cutter wheel. The gripping surface of the traction wheel and the cutter wheel define a gap for receiving the rim of the can therebetween. The activation lever preferably upstands from the top of the cutter support and is pivotable about the shaft. The lever preferably defines cam means in communication with the shaft to move the traction wheel toward the cutter wheel upon rotation of the lever. The drive motor is linked to the shaft to rotate the shaft and the traction wheel upon depression of the activation lever. In operation, the cutter wheel and the traction wheel cooperate to separate the rim of the can received in the gap upon depression of the lever and activation of the motor.

The appliance also preferably includes guide means projecting from the vertical wall of the cutter support. The guide means preferably includes at least a pair of orienting pins adapted to position the top of the can at an angle of 5 degrees relative to the vertical direction. The cutter wheel is preferably mounted with its plane oriented at an angle of 77.5 degrees relative to the vertical direction. The appliance preferably also includes a socket mounted within the cutter support. The socket is adapted to receive the axis of the cutter wheel and has a top surface that is substantially parallel to the plane defined by the cutter wheel. The appliance also preferably includes a bearing means mounted between the cutter wheel and the top surface of the socket. The cutter wheel rests on a spacer ring which in turn rests on top of the bearing.

Another aspect of the invention is directed to a method for opening a can including of the following steps. First, an appliance for opening cans is provided. The appliance includes a cutter support having a first vertical wall, a cutter wheel, a traction wheel, an activation lever, and a drive motor. The cutter wheel is rotatable about an axis, and is mounted at least partially within the cutter support so that the axis of rotation is substantially parallel to the vertical wall and an edge of the wheel is exposed from the cutter support. The cutter wheel comprises 01 draw tool steel having a hardness range of between approximately 53 and 57 on the Rockwell C scale. The traction wheel is mounted to a distal end of a shaft. The annular portion of the traction wheel preferably comprises a gripping surface. The shaft is mounted to the cutter support and is substantially perpendicular to the axis of the cutter wheel. The shaft and the traction wheel are moveable axially relative to the cutter support and the cutter wheel. The gripping surface of the traction wheel and the edge of the cutter wheel define a gap for receiving the rim of the can therebetween. The activation lever preferably upstands from the top of the cutter support and is pivotable about the shaft. The lever preferably defines cam means mounted annularly around the shaft and configured to urge the traction wheel toward the cutter wheel upon rotation of the lever. The drive motor is linked to the shaft to rotate the shaft and the traction wheel upon depression of the activation lever. Next, the operator moves the can so that the can is gripped between the cutter wheel and the traction wheel of the appliance. Then, the operator depresses the activation lever to power the drive motor of the appliance. Last, the rim of the can is separated from the rest of the can by the cutting action of the cutter wheel against the can as the traction wheel drives the cutter wheel around the circumference of the can.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PREFERRED EMBODIMENTS

Figure 1:
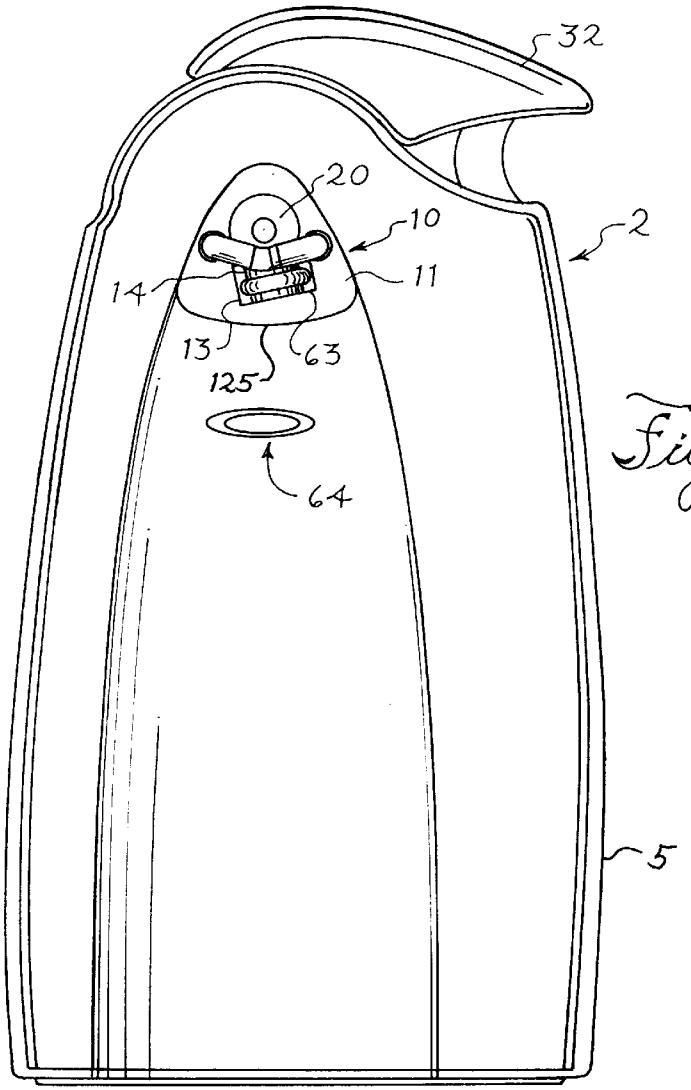
FIG. 1 is a front view of a preferred embodiment of the present invention.

FIG. 1 illustrates a front view of the can opener appliance 2 of the present invention. The appliance 2 includes a cutter support 10 having a first vertical wall 11, a cutter wheel 14, a traction wheel 20, and an activation lever 32. As shown in the exploded drawing of FIG. 2, the appliance 2 preferably includes two housing portions 5, 6 that connect with each other. The front housing portion 5 and the rear housing portion 6 may be connected together by any conventional means, including, for example, snap fitting one to another via tabs 150 and/or connecting the two housing portions by means of fasteners such as screws. Inside the housing portions 5, 6 of the appliance 2, the cutter support 10, cutter wheel 14, traction wheel 20 and a drive motor 80 are positioned.

The cutter support 10 is preferably plated die-cast steel. Other materials, of course, may be used. Referring back to FIG. 1, a pocket area 13 is formed through the vertical wall 11 of the cutter support 10. Preferably, the pocket area 13 is of rectangular cross section and includes a bottom surface 63. Preferably, the surface 63 is substantially flat, and oriented at an angle of about 77.5 degrees to the vertical.

Figure 3:
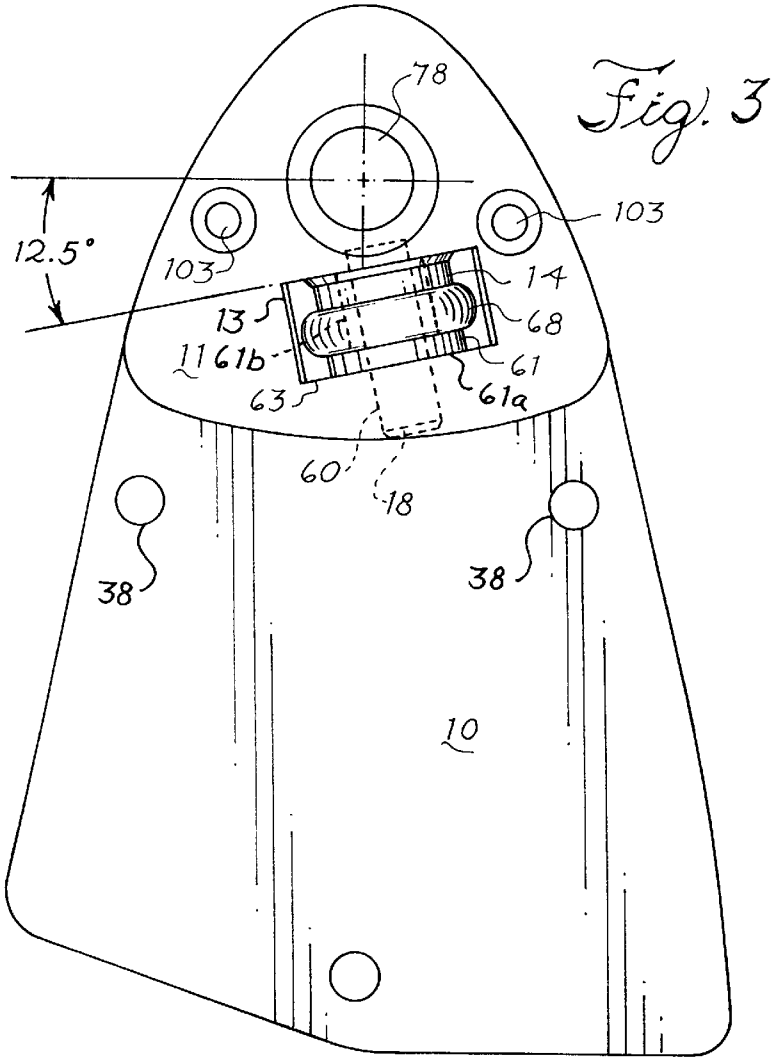
FIG. 3 is a front plan view of the cutter support portion of the embodiment shown in FIG. 1.

As shown in FIG. 3, the cutter wheel 14 is mounted at least partially within the cutter support 10 of the appliance 2. In particular, the cutter wheel 14 is mounted over a cylindrical pin 18 that defines the axis of the cutter wheel 14. The pin 18 is press-fit into a bearing 61 and is preferably oriented substantially parallel to the vertical wall 11 of the cutter support 10. The axis of the cutter wheel 14 is preferably mounted at an angle relative to the vertical. This has been found to improve the engagement of the cutter wheel 14 with the seam of the can. An appropriate angle is about 12.5 degrees from the vertical.

The cutter support 10 preferably includes a cylindrical socket 60 defined within the cutter support 10 and extending normally downwardly from the surface 63 of the pocket area 13. The socket 60 is preferably adapted to receive a distal end of the pin 18. Also, the socket 60 is preferably positioned such that the bottom surface 63 of the pocket area 13 is substantially parallel to the plane defined by the cutter wheel 14. Bearing means 61 is preferably mounted to rest on the bottom surface 63. Preferably, bearing means 61 is a bronze bushing. Sandwiched between the cutter wheel 14 and the bearing 61 is a plated steel spacer ring 68. The spacer ring 68 has a radius that extends radially from the pin 18 to a slightly larger (approximately 1–2 mm) radius than the cutter wheel 14. The cutter wheel 14 portion preferably rests on the spacer ring 68, which in turn rests on the bottom portion 61 a of the bearing 61. The spacer ring 68 and cutter wheel 14 are concentrically mounted over a reduced-diameter upper cylindrical portion 61*b* of the bearing 61 and may together rotate relative to the pin.

Figure 4:
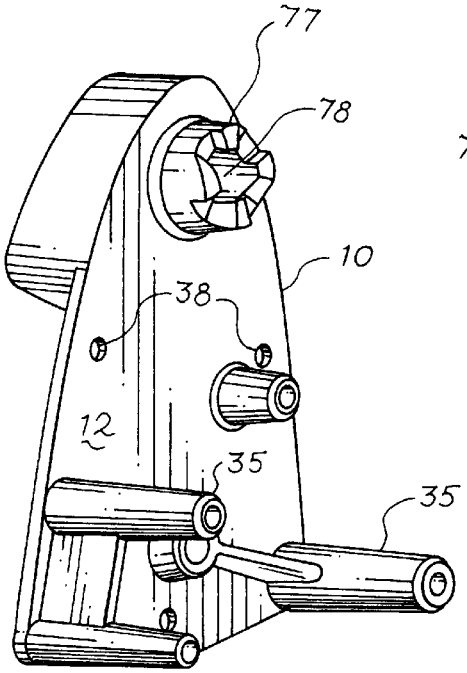
FIG. 4 is a rear view of the support shown in FIG. 2.

The cutter support 10 is mounted inside the appliance 2 so that the vertical wall 11 projects through an opening 125 in the front housing portion 5 of the appliance. Although the cutter support 10 may be mounted by any conventional means, preferably a pair of fasteners, such as screws, mounts the cutter support 10 to the housing portion 5 of the appliance 2. As shown in FIG. 4, which depicts the rear side of the cutter support 10, a pair of fastener receiving sockets 35 are defined to project from the rear side of the support 10. As shown in the exploded drawing of FIG. 2, fasteners 36 mount the motor 80 to the receiving sockets 35 on the rear of the support 10. The support 10 is in turn fastened to the front housing 5 using conventional screws through openings 38 defined within the support 10.

Figure 5:
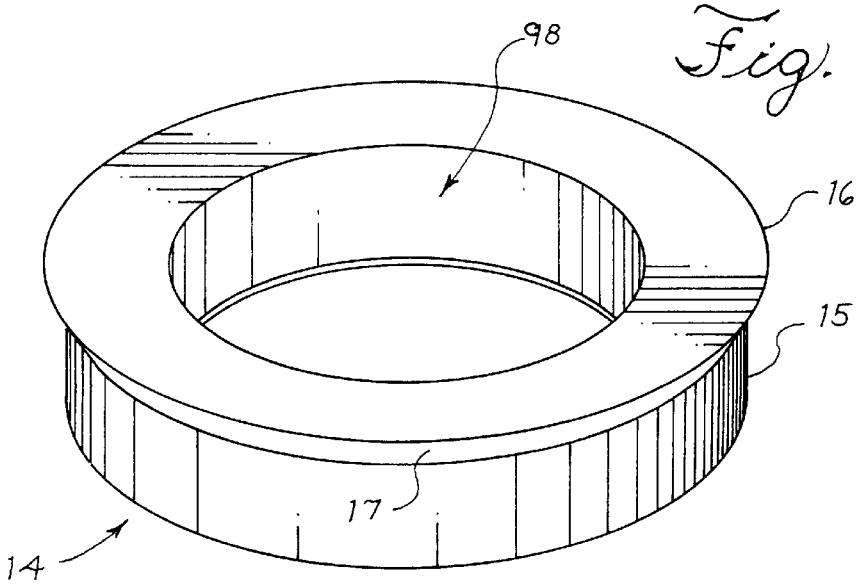
FIG. 5 is a perspective view of the cutter wheel of the present invention.

As shown in FIG. 5, the cutter wheel 14 preferably includes an axially cylindrical edge portion 15 and a tapered portion 17 that defines the cutting edge 16. The tapered portion 17 is preferably angled 30 degrees to the plane defined by the face 14*a* of the cutter wheel 14. A bore 98 is defined centrally within the cutter wheel 14 for mounting the upper portion 61*b* of cylindrical bearing means 61. Preferably, the bore 98 is sized with a radial clearance of 0.25 mm between the radius of the bearing means 61 and the radius of the bore 98 to allow the wheel to rotate relative to the pin 18.

At least a portion of the cutting edge 16 protrudes outwardly from the cutter support 10 to allow the cutting edge 16 to contact a can during the cutting operation of the appliance 2. Preferably, at its widest exposure, the outermost edge portion 15 of the cutter wheel 14 projects approximately 1.26 mm beyond the plane face of the vertical wall 11 of the support 10.

Additionally, the cutter wheel 14 is comprised of a metal such as a drawn tool steel having a particular hardness on the Rockwell C hardness scale. Preferably, in the preferred embodiment herein, the cutter wheel 14 is comprised of drawn tool steel that has a hardness of between about 53 to about 57 on the Rockwell C scale. In particular, if the drawn tool steel has a lower hardness than this range, then the drawn tool steel may be too soft so that the edge of the cutter wheel may fold over after relatively few usage cycles. Similarly, if the drawn tool steel has a higher hardness than this range, then the steel may be too brittle so that the edge of the cutter wheel may shatter in operation. Accordingly, it was found that a cutter wheel comprised of drawn tool steel having a hardness of about 53 to about 57 on the Rockwell C scale was beneficial for its ability to cut through rims of cans in the preferred appliance without folding over or shattering, while also being beneficial for wear of the cutter wheel.

In the alternative, it has been determined that SK4 tool steel that exhibits a hardness of between 60 and 62 on the Rockwell C may also provide an acceptable cutting wheel material in the present appliance 2.

Figure 6:
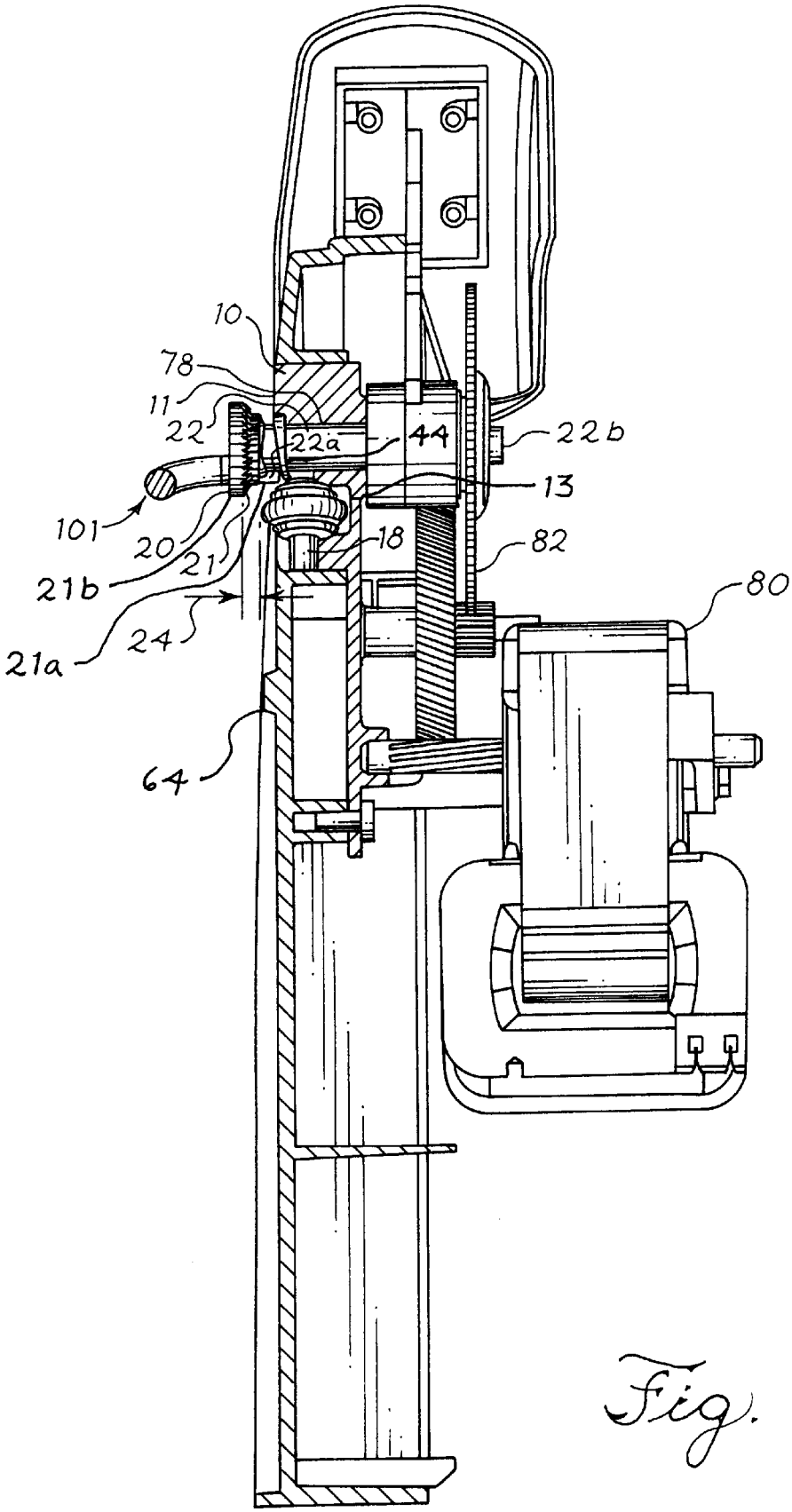
FIG. 6 is a side view of the preferred embodiment of FIG. 2 taken through line 4—4.

As shown in FIG. 6, the traction wheel 20 is mounted on a rotatable shaft 22 that defines the axis of the traction wheel 20. The traction wheel 20 defines a gripping surface 21 on its annular, outer surface. Preferably, the gripping surface 21 is in the form of teeth extending radially along two adjacent annular surfaces on the wheel 20. Preferably, a first gripping surface 21*a* extends annularly around the wheel 20 at an angle of 120 degrees relative to the shaft 22. A second gripping surface 27*b* extends parallel to the shaft 22 at annularly around the shaft. The traction wheel 20 preferably is machined from 1144 cold-rolled steel.

Figure 2:
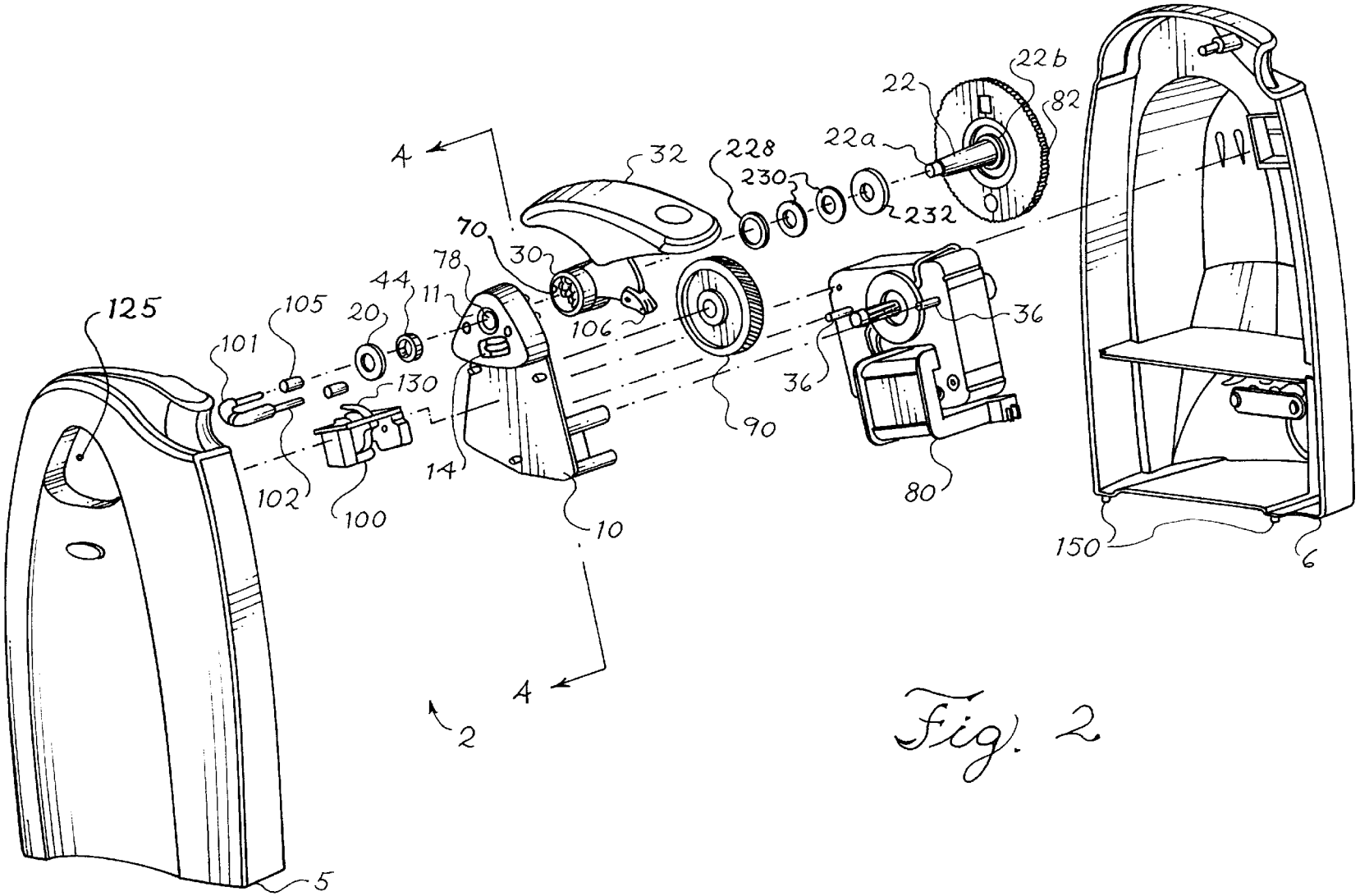
FIG. 2 is an exploded, perspective view of the preferred embodiment of FIG. 1.

Preferably, the traction wheel 20 is threaded onto a threaded first distal end 22*a* of the shaft 22. The shaft 22 is preferably mounted generally parallel to the plane of the cutter wheel 14 and so that its axis is substantially perpendicular to the vertical wall 11 of the cutter support 10. Accordingly, the axis of the shaft 22 of the traction wheel 20 is preferably substantially perpendicular to the axis of the pin 18 of the cutter wheel 14. As shown in FIG. 2, The cutter support 10 defines an aperture 78 through which the shaft 22 is mounted. At the first distal end 22*a* of the shaft 22, the traction wheel 20 is mounted to compress a spring 44 between the traction wheel 20 and the vertical wall 11 of the cutter support 10. The opposing distal end 22*b* of the shaft 22 is inserted through a flat washer 228, a pair of opposing conical washers 230, and a doughnut-shaped spacer 232 as shown in FIG. 2. This washer and spacer configuration assists in relieving the axial force between the cutter wheel 14 and the traction wheel 20 during the cutting operation. The distal end 22*b* is mounted to a gear 82 which is driven by a gear motor 80 via an idler gear 90. The shaft 22 and the traction wheel 20 are reciprocally movable axially relative to the cutter support 10 and thus the cutter wheel 14.

As stated above, the cutter wheel 14 and the traction wheel 20 are mounted in the appliance 2 such that pin 18 and shaft 22, and thus the axes of rotation of the wheels 14 and 20, are preferably substantially perpendicular to each other. The traction wheel 20 is also positioned so that its axis and shaft 22 intersect the axis of the cutting wheel 14 and pin 18. Additionally, as shown in FIG. 6, the cutter wheel 14 and the traction wheel 20 are mounted such that the wheels 14 and 20 are positioned adjacent but spaced from each other to define a gap 24 able to hold the rim of a can to be opened. Accordingly, the gripping surface 21 of the traction wheel 20 and the cutter wheel 14 define the gap 24 for receiving the rim of a can.

The traction wheel 20 is movable towards the cutter wheel 14 to close the gap 24. This movement engages and locks the rim of a can to be opened between the cutter wheel 14 and the traction wheel 20. When a can is so engaged and locked, the cutter wheel 14 severs the rim as the traction wheel 20 acts to move the can past the cutter wheel 14.

Figure 7:
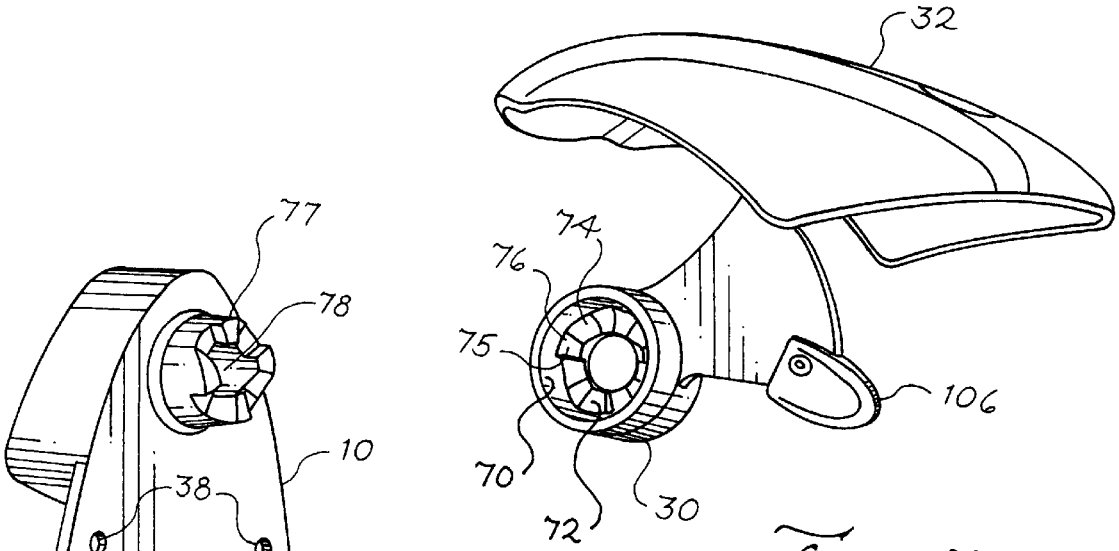
FIG. 7 is a perspective view of the activation lever and related components of the preferred embodiment.

Referring now to FIG. 7 in conjunction with the previous Figures, the lever 32 extends above or upstands from the top of, the appliance 2 and is fixed to a presser housing 30. The presser housing 30 is pivotably mounted concentrically about the shaft 22. As shown in FIG. 7, the presser housing 30 defines cam means 75 which is in communication with the shaft 22 and opposing protrusions 77 having an aperature 78 on the rear of cutter support 10. The interior of the presser housing 30 defines an annular area 70 with a plurality of tapered surfaces 72, along with low points 74 and high points 76. Similarly, the rear side 12 of the cutter support 10 defines a plurality of upstanding protrusions 77 arranged in an annular structure to cooperate with the low points 74 and high points 76 of the presser housing support 30. In particular, the low points 74 and high points 76 on the presser housing support 30 register with the protrusions 77 on the cutter support 10, thereby pressing against the protrusions 77 and pushing the distal end 22*b* of shaft 22 away from the cutter support 10. This draws the traction wheel 20 axially toward the vertical wall 11 of the cutter support 10 and thus the cutter wheel 14. Of course, other cam means may be substituted for the structures described herein. For example, an increasing spiral on the outside of presser housing 30 may be utilized to move the traction wheel 20 and shaft 22 axially using a ramping effect. In the alternative, a threaded interface may be constructed between the presser housing 30 and the cutter support 10 to move the presser housing 30 axially relative to the support 10.

Preferably, the cam means allows the traction wheel 20 to move towards and away axially from the vertical face 11 within a range of 2.28 mm. At its most retracted position, the inner edge portion of the traction wheel 20 is positioned 0.2 mm from the cutting edge 16 of the cutting wheel 14. These values have been shown to be the most effective for operation of the present embodiment.

As shown in FIGS. 2 and 6, the appliance 2 also preferably includes guide means 101 which project from the vertical wall 11 towards one of the housing portions 5, 6 of the appliance 2. As shown, the guide means 101 projects toward sidewall 5 of the appliance 2. The guide means 101 preferably includes at least a pair of orienting pins 102 which are adapted to orient the top of a can at an angle of 5 degrees relative to the angle of the shaft 22 of the traction wheel 20. The pins 102 are fitted into bores 103 in the wall 11 of the support 10. Rollers 105 are loosely placed over the pins 102 to facilitate movement of the can rim against the guide means 101.

A protrusion guide 64 extends outwardly from the front housing 5. The guide 64 provides lateral support to the side of a can as its rim is engaged during operation.

Figure 8:
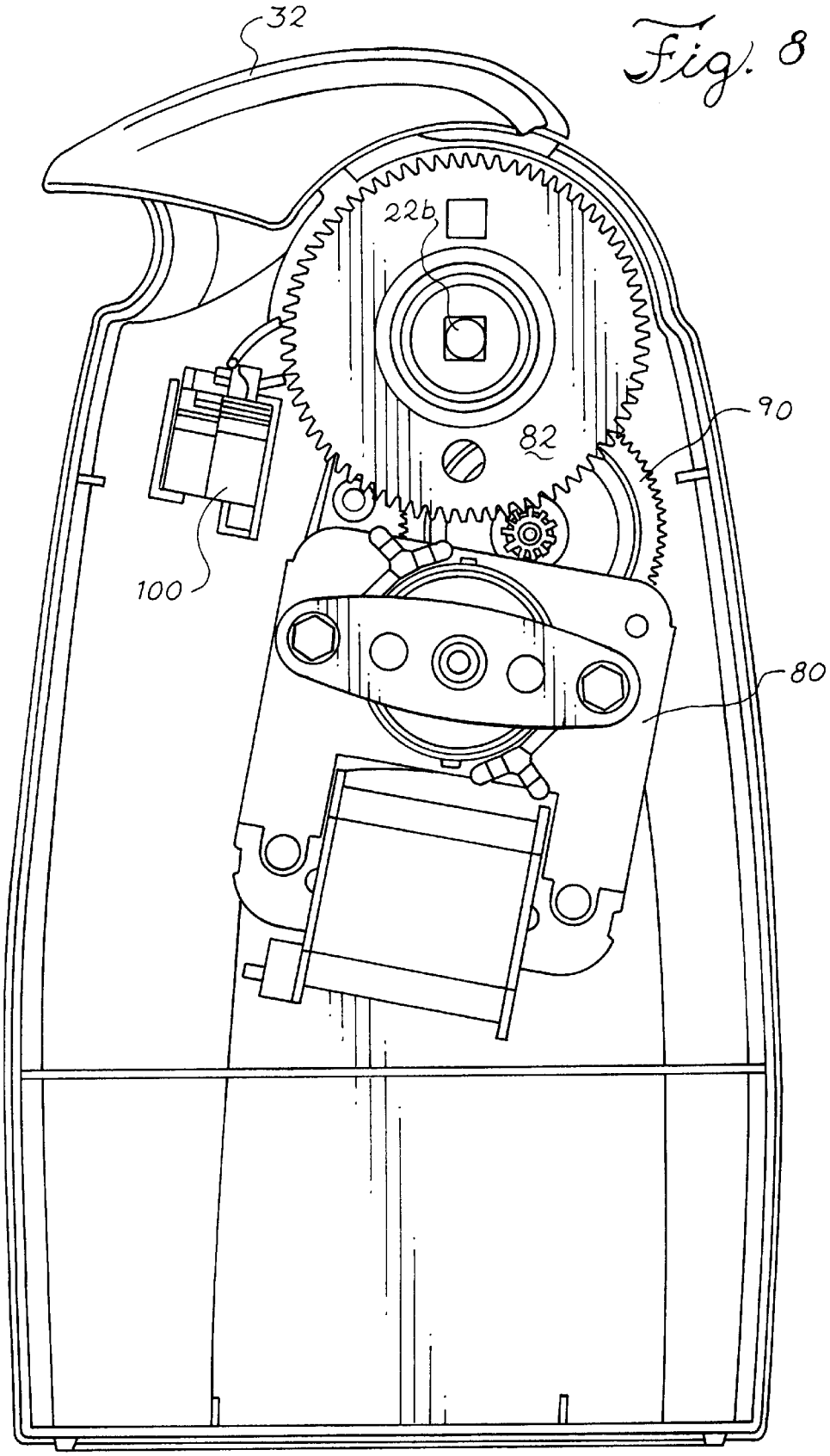
FIG. 8 is a rear plan view of the embodiment shown in FIG. 1, with the rear housing portion of the appliance removed.

Preferably, the appliance 2 is an electrical appliance that also includes a motor 80. The motor 80 acts to turn the traction wheel 20 that in turn acts to move the can past the cutter wheel 14. Referring now to FIG. 8 in conjunction with previous Figures, the motor 80 interfaces with an idler gear 90, which in turn interfaces with the gear 82. The gear 82 is connected with the traction wheel 20. Specifically, the distal end 22*b* of the shaft 22 of the traction wheel 20 is connected with the gear 82. Accordingly, once the motor 80 is activated, the motor 80 turns the gears 82 and 90 which turns the shaft 22. This then turns the traction wheel 20. While any suitable and conventional motor for operating a can opener appliance may be utilized, the motor 80 is preferably a 120 volt rated AC current motor.

The appliance 2 also includes a switch 100. The switch 100 works in conjunction with the lever 32 to activate, i.e., to turn "on," the motor 80. In particular, when the operator first depresses the lever 32, this movement initially causes the traction wheel 20 to be moved in the axial direction to close the gap 24 between the traction wheel 20 and the cutter wheel 14. When the lever 32 is in this depressed position, the finger 106 on lever 32 closes the switch 100 by moving switch arm 130. The switch 100 then allows power to the motor 80. As discussed above, once the motor 80 is activated, the motor 80 turns the gears 82 and 90 which turn the traction wheel 20 to move the can around against the cutter wheel 14.

The present invention is also directed to a method of opening a can preferably using the appliance described above. During operation, the operator places the rim of a can between the traction wheel 20 and the cutter wheel 14. Upon depressing the lever 32, the presser housing 30 and, more particularly, the tapered surfaces 72, low points 74 and high points 76 of the presser housing 30, press against the protrusions 77 of the rear side 12 of the cutter support 10 thereby drawing the traction wheel 20 axially toward the cutter support 10 and the cutter wheel 14. As the traction wheel 20 is drawn inward, this movement also pulls on the inside edge of the can rim, thereby drawing the can toward the cutter wheel 14. The cutter wheel 14 then engages the rim of the can and the cutting edge 16 of the cutter wheel 14 cuts into the outside rim seam of the can. Depressing the lever 32 also triggers the switch 100, which activates the gear motor 80. The motor 80 turns the gears 82 and 90, thereby turning the shaft 22 and the traction wheel 20. The traction wheel movement rotates the can. The lid or top of the can is then separated from the can body by the cutter wheel 14 as the cutter wheel 14 travels around the circumference of the can rim.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. An appliance for removing the rim of a can, said appliance comprising:

a cutter support having a first vertical wall;

a cutting wheel rotatable around an axis, said cutting wheel mounted at least partially within said cutter support so that said axis of rotation is substantially parallel to said first vertical wall and an edge of said wheel is exposed from said cutter support, said cutting wheel comprising drawn tool steel having a hardness range of between approximately 53 and 57 on the Rockwell C scale and said axis of said cutting wheel being mounted at an angle of approximately 12.5 degrees relative to vertical;

a traction wheel mounted to a distal end of a shaft, an outer portion of said traction wheel defining a gripping surface, said shaft mounted to said cutter support and substantially perpendicularly to said axis of said cutting wheel, said shaft and said traction wheel being reciprocally movable axially relative to said cutter support and said cutting wheel, said gripping surface and said cutting wheel defining a gap for receiving the rim of a can therebetween;

a guide means projecting from said first vertical wall that includes a plurality of orienting pins adapted to orient the top of a can at an angle of approximately 5 degrees relative to the angle of said shaft;

an activation lever upstanding from the top of said cutter support and pivotable about said shaft, said lever defining cam means in communication with said shaft to move said traction wheel toward said cutting wheel upon rotation of said lever;

a drive motor linked to said shaft to rotate said shaft and said traction wheel upon depression of said activation lever;

wherein said cutting wheel and said traction wheel cooperate to separate the rim of said can received in said gap upon depression of said lever and activation of said drive motor.

2. The appliance of claim 1 wherein said orienting pins include first and second orienting pins, the orienting pins being disposed on opposite sides of said cutting wheel.

3. The appliance of claim 2 further comprising a socket mounted within said cutter support, said socket adapted to receive said axis of said cutting wheel and having a top surface substantially parallel to the plane defined by said cutting wheel.

4. The appliance of claim 3 further comprising a bearing means mounted between said cutting wheel and said top surface of said socket, said cutting wheel resting on said bearing means.

5. The appliance of claim 1 wherein said cutting wheel includes a tapered portion that is tapered at approximately 30 degrees to a face of said cutting wheel.

6. The appliance of claim 1 further comprising a front housing portion mounted adjacent to the cutter support, and wherein each of the plurality of orienting pins comprises a roller that facilitates movement of the can.

* * * * *

UNITED STATES PATENT AND TRADEMARK OFFICE

CERTIFICATE OF CORRECTION

PATENT NO. : 6,189,221 B1
DATED : February 20, 2001
INVENTOR(S) : Mary K. Barrow et al.

It is certified that error appears in the above-identified patent and that said Letters Patent is hereby corrected as shown below:

Title page,
Line 16, under "ABSTRACT", immediately after "wheel" insert -- . -- (period).

Signed and Sealed this

Second Day of April, 2002

*Attest:*

*Attesting Officer*

JAMES E. ROGAN
*Director of the United States Patent and Trademark Office*